United States Patent [19]

Deutsch

[11] 4,135,427

[45] Jan. 23, 1979

[54] ELECTRONIC MUSICAL INSTRUMENT RING MODULATOR EMPLOYING MULTIPLICATION OF SIGNALS

[75] Inventor: Ralph Deutsch, Sherman Oaks, Calif.

[73] Assignee: Deutsch Research Laboratories, Ltd., Los Angeles, Calif.

[21] Appl. No.: 675,721

[22] Filed: Apr. 12, 1976

[51] Int. Cl.[2] ..... G10H 1/02; G10H 5/00

[52] U.S. Cl. ..... 84/1.22; 84/1.24

[58] Field of Search ..... 84/1.01, 1.22–1.25, 84/DIG. 4, DIG. 5

[56] References Cited

U.S. PATENT DOCUMENTS

| | | | |
|---|---|---|---|
| 3,809,792 | 5/1974 | Deutsch | 84/1.24 |
| 3,88 4,108 | 5/1975 | Deutsch | 84/1.24 |
| 3,978,755 | 9/1976 | Woron | 84/1.24 |

*Primary Examiner*—Stanley J. Witkowski
*Attorney, Agent, or Firm*—Ralph Deutsch

[57] ABSTRACT

Two sets of digital tone generators are provided for a musical instrument. The members of the first set of generators create data which represent discrete amplitudes of a musical waveshape corresponding in the time domain to be true musical frequencies played by the musician. The members of the second set of generators create data which represent discrete amplitudes of a different waveshape corresponding in the time domain to frequencies which in general are note selected as true musical frequencies. Provision is made for multiplying the data created by selecting pairs of digital tone generators, one from each of the two sets. The resulting modulated data is converted into analog signals in a form suitable for a conventional sound system.

10 Claims, 4 Drawing Figures

ELECTRONIC MUSICAL INSTRUMENT RING MODULATOR EMPLOYING MULTIPLICATION OF SIGNALS

BACKGROUND OF THE INVENTION

1. Field of the Invention

The present invention relates to the production of musical waveshapes by digital tone generators.

2. Description of the Prior Art

A popular tonal effect used in musical tone synthesizers is that which is generically called "ring modulation." The same fundamental frequency modification phenomenon has been known for many years in communication systems as "balanced modulation." In these modulation systems, two signals at different frequencies are combined such that the output signal contains spectral components at the sum and difference frequencies of the original two signals. In an ideal ring modulator, the output signal would have no frequency component corresponding to that of either input signals. While such an ideal ring modulator is almost impractical to build using conventional analog techniques, it is a feature of the present invention that the ideal ring modulator can be mechanized simply and economically by the use of digital system techniques.

Let the first musical signal be represented at the discrete points $x_1(gh)$; $g=1,2,\ldots$ as a Fourier series of the form $$x_1(gh) = \sum_q c_q \sin(2\pi qg/N_1)$$

where h is a fixed time interval and $N_1$ is the number of intervals of length h in the fundamental period of $x_1$, $N_1/2$ is the harmonic number; $c_q$ is the harmonic coefficient corresponding to the qth harmonic. A second musical signal having the same number of harmonic components is similarly represented as $$x_2(kh) = \sum_k d_k \sin(2\pi kg/N_2).$$

$N_2$ is the number of intervals of length h in the fundamental period of $x_2$. $k=1,2,\ldots,N_2/2$ is the harmonic number and $d_k$ is the harmonic coefficient for the second musical signal corresponding to the k'th harmonic. The ideal ring modulator creates the product y defined as $$y = x_1(gh)\cdot x_2(gh)$$

$$= \sum_q \sum_k c_q d_k \sin(2\pi qg/N_1)\sin(2\pi kg/N_2)$$

$$= \sum_q \sum_k c_q d_k \left\{ \cos\left[2g\left(\frac{q}{N_1} + \frac{k}{N_2}\right)\right] - \cos\left[2\pi g\left(\frac{q}{N_1} - \frac{k}{N_2}\right)\right]\right\}.$$

SUMMARY OF THE INVENTION

In a Polyphonic Tone Synthesizer of the type described in the copending Patent application No. 603,776 entitled Polyphonic Tone Synthesizer filed on Aug. 11, 1975, and now U.S. Pat. No. 4,085,644, computation cycle and a data transfer cycle are repetitively and independently implemented to provide data which is converted to musical waveshapes. The tonal effect called by the generic term "ring modulation" is incorporated by creating two master data sets which are converted to analog signals of different frequencies in such a manner that the result is equivalent to the multiplication of the two signals into a single analog signal. This is also called the ring modulator effect. During the first portion of the computation cycle a first master data set is created by implementing a discrete Fourier algorithm using a stored set of harmonic coefficients which characterize a musical tone and during the second portion of the computation cycle a second master data set is similarly created using a second stored set of harmonic coefficients. The computations are carried out at a fast rate which may be nonsynchronous with any musical frequency. Preferably the harmonic coefficients and the orthogonal functions are stored in digital form and the computations are carried out digitally. At the end of the computation cycle a first and second master data set have been created and temporarily stored in their respective data registers.

Following a computation cycle, a transfer cycle is initiated which transfers each master data set to preselected members of a multiplicity of read-write memories. The transfer of the first master data to the selected read-write memories is initiated by detection of a synchronizing bit and is timed by a clock which may be asynchronous with the main system clock and has a frequency Pf, where f is the frequency of a particular note assigned to a memory and P is two times the maximum number of harmonics in the musical waveshape. The transfer of the second master data set to selected read-write memories is also initiated by detection of a synchronizing bit and is timed by a clock selected to differ from the true value of Pf. The transfer cycle is completed when all the assigned memories have been loaded, at which time a new computation cycle is initiated. Tone generation continues uninterrupted during computation and transfer cycles.

A digital-to-analog convertor converts the digital signals read out of a memory containing data corresponding to the off-tune frequency to an analog reference signal. This analog reference signal acts as the reference voltage for a second digital-to-analog convertor which converts the digital signals read out of a memory containing data corresponding to an on-tune frequency. The net result is the multiplication of the two converted digital signals into a single analog signal.

Means are described for generating the out-of-tune frequency clocks.

BRIEF DESCRIPTION OF THE DRAWINGS

A detailed description of the invention will be made with reference to the accompanying drawings wherein like numerals designate like components in the several figures.

DESCRIPTION OF THE PREFERRED EMBODIMENT

The following detailed description is of the best presently contemplated modes of carrying out the invention. This description is not to be taken in a limiting sense, but is made merely for the purpose of illustrating general principles of the invention since the scope of the invention is best defined by the appended claims. Structural and operational characteristics attributed to forms of the invention first described shall also be attributed to forms later described, unless such characteristics are obviously inapplicable or unless specific exception is made.

Figure 1:
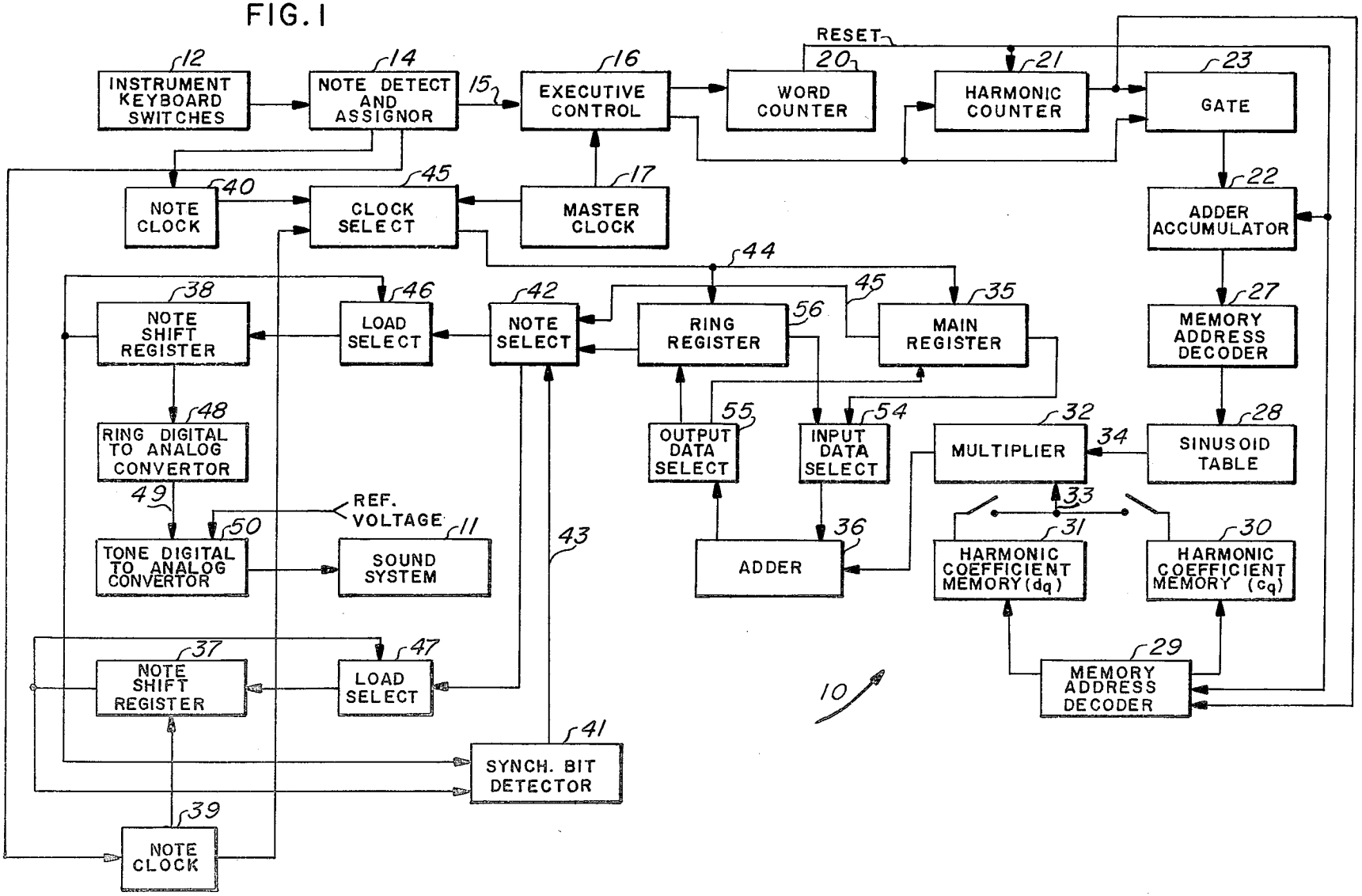
FIG. 1 is an electrical block diagram of a polyphonic tone synthesizer configured to produce ring modulator effects.

System 10 of FIG. 1 illustrates the ring modulator used in conjunction with the Polyphonic Tone Synthesizer, copending U.S. Patent application No. 603,776, filed on Aug. 11, 1975, and now U.S. Pat. No. 4,085,644. In the polyphonic tone synthesizer a master data set is created in main register 35. The entire system logic is controlled by master clock 17 while the master data set is constructed. After the completion of the generation of this data set, the data is transferred via note select 42 to an assigned load select, for example, load select 47. From the assigned load select 47, the data is in turn loaded into a corresponding note shift register 37. The transfer and subsequent data loading is accomplished by means of a note clock which has been assigned by note detect and assignor 14 to generate a frequency corresponding to an actuated key on the instrument keyboard. A second master data set is created and stored in ring register 56. The second master data set is usually generated from a different set of harmonic coefficients from those used to generate the master data set. The ring register contents are transferred to note shift register 38 via load select 46 under timing control of note clock 40. Note clock 40 is assigned to the actuated key switch corresponding to the assignment of note clock 39. In general, the frequency of note clock 40 differs from that of note clock 39. Note clock 39 does correspond in frequency to the musical note actuated on the instrument's keyboard.

The digital data read out from note shift register 38 is converted to an analog voltage waveshape by means of ring digital-to-analog convertor 48. The output from this digital-to-analog convertor is used as the reference voltage for tone digital-to-analog convertor 50. Tone digital-to-analog convertor 50 is used to convert the digital data read out from note shift register 37 to an analog voltage waveshape.

The combination of Main Register 35, Note Shift Register 37 and Note Clock 39 constitutes a digital waveshape generator with a frequency determined by Note Clock 39. This digital waveshape generator in combination with the Digital-to-Analog Convertor 50 constitutes a tone generator. Because the basic waveshape is generated as digital numbers, the combination of the digital waveshape generator and the digital-to-analog convertor is called a digital tone generator. A second digital waveshape generator is constituted by the combination of Ring Register 56, Note Shift Register 38 and Note Clock 40 with a frequency determined by Note Clock 40. The second digital waveshape generator in combination with the digital-to-analog convertor constitutes a second digital tone generator.

The first and second master data sets residing respectively in main register 35 and ring register 56 are created during a computation cycle. The system timing and control functions are accomplished within the executive control 16 system logic block. The first master data set is computed according to the relation $$Z(N) = \sum_{q=1}^{W} c_q \sin(2\pi Nq/2W) \qquad \text{(Equation 1)}$$

for values of N=1,2,3 . . . ,2W. The second master data set, which resides in ring register 56, is computed according to the relation $$R(N) = \sum_{q=1}^{U} d_q \sin(\pi Nq/W) \qquad \text{(Equation 2)}$$

where the number of harmonics U is less than or equal to the number of harmonics W used to compute the first master data set.

The polyphonic tone synthesizer 10 comprising a ring modulation of FIG. 1 operates to produce sound via a sound system 11 tones corresponding to the product of the first and second master data sets. The output tones correspond to the relation $$y = Z\,R \qquad \text{(Equation 3)}$$

wherein Z is a musical waveshape generated from the first master data set values Z(N) having a frequency corresponding to the key switch actuated on the keyboard and R is generated from the second master data set values R(N) and translated into a predetermined different frequency from that corresponding to the actuated keyboard key switch.

The combination of the two signals Z and R by multiplication is in reality a modulation of the type called by such terms as a balanced modulator, or a ring modulator. Thus the output y will contain spectral components at the sum and difference frequencies.

As described below, each such combination musical waveshape is generated by first computing a first and second master data set (as described in copending U.S. Patent application No. 603,776 filed on Aug. 11, 1975 entitled POLYPHONIC TONE SYNTHESIZER and now U.S. Pat. No. 4,085,644).

While the invention is illustrated for the combination of two tones or "stops," one fixed in frequency corresponding to the first master data set, and the second offset in frequency corresponding to the second master data set, the extension to any plurality of tones should be apparent to those skilled in the art. The number of harmonics, W, is a design choice, however the use of 32 harmonics (W=32) is satisfactory for synthesizing the "bright" tonal sounds of a musical tone synthesizer.

Whenever a switch is actuated on the instrument keyboard switches, its actuation is detected by the note detect and assignor 14. The detection of an actuated key causes the assignment of a temporary memory position in 14 containing data that identifies which particular key has been actuated. Note detect and assignor 14 transmits via line 15 to executive control 16 the information that a key has been detected as having been actuated on the instrument keyboard switches 12.

Means for implementing note detect and assignor 14 are described in U.S. Pat. No. 4,022,098 entitled KEYBOARD SWITCH DETECT AND ASSIGNOR.

The logic timing for system 10 of FIG. 1 is furnished by master clock 17. A fairly wide range of frequencies can be used for master clock 17; however advantageously a design choice is 1.0 Mhz.

The executive control 16 transmits control signals to several of the system logic blocks to synchronously time various system logic functions.

The computation cycle is defined as a repetitive event whose function is to compute Equation 1 and Equation 2. The computation cycle is composed of two subcycles (or subcomputation cycles), the first allocated to the computation of Equation 1 and the second allocated to the computation of Equation 2. At the beginning of a computation subcycle word counter 20, harmonic counter 21, and adder-accumulator 22, are all initialized to a value "1" by executive control 16. The first subcycle of the computation cycle is called the master subcomputation cycle and the second subcycle is called the ring subcomputation cycle.

At time $t=t_1$, corresponding to the first bit time of the master subcomputation cycle during which Equation 1 is computed, the word counter 20 has the number one as its content. The harmonic counter 21 also contains the number one. The number in harmonic counter 21 is transmitted via gate 23 to adder-accumulator 22 at time $t_1$. The memory address decoder 27 receives the number $Nq=1\times 1$ from adder-accumulator 22 and causes the value $S_{1,1}=\sin[\pi(1\times 1)/W]$ to be read out from sinusoid table 28.

The memory address decoder 29 receives the number contained in word counter 20 to select either harmonic coefficient memory 30 or harmonic coefficient memory 31. The selection is accomplished by a flip-flop caused to change state whenever word counter 20 is initialized for the start of a subcomputation cycle. Thus for the master subcomputation cycle, memory address decoder selects harmonic coefficient memory 30 and addresses the appropriate harmonic coefficient $c_q$ corresponding to the proper harmonic number q associated with each bit time in the subcomputation cycle in response to the input data q. Similarly during the ring subcomputation cycle, memory address decoder 29 is caused to address the harmonic coefficients $d_q$ residing in the harmonic coefficient memory 31.

At time $t_1$, memory address decoder 29 causes the harmonic coefficient $c_1$ to be read from harmonic coefficient memory 30. The input signals to multiplier 32 are $c_1$ on line 33 and $S_{1,1}$ on line 34. Therefore, the output of multiplier 32 is the product term $c_1S_{1,1}$.

Main register 35 is a read-write memory, which advantageously may comprise an end-around shift register. The contents of main register 35 are initialized to a zero value at the start of the master subcomputation cycle. During the master subcomputation cycle input data select 54 causes the data read out of main register 35 to pass to adder 36. During the ring computation cycle, input data select 54 causes the data read out of ring register 56 to pass to adder 36. Correspondingly, during the master subcomputation cycle the output of adder 36 is directed to main register 35 and during the ring subcomputation cycle the output of adder 36 is directed to ring register 56.

At the second bit time $t_2$, word counter 20 is incremented to the value 2 by a signal received from executive control 16. The harmonic counter 21 is maintained at the value of 1 and will retain this value during the first 64 bit times of the master subcomputation cycle. Adder-accumulator 22 receives the current value of q from harmonic counter 21 via gate 23 at each bit time. Therefore at time $t_2$, adder-accumulator 21 has the value $Nq=2$. The value $Nq=2$ is transmitted to memory address decoder 27 which in turn causes the value $S_{2,1}=\sin[\pi(2\times 1)/W]$ to be addressed out from sinusoid table 28. At time $t_2$, the harmonic coefficient $c_1$ is read from harmonic coefficient memory 30. The output signal from multiplier 32 is the value $c_1S_{2,1}$ which is added by adder 36 to the initial zero value of word No. 2 in main register 30 so that the net result is that the value $c_1S_{2,1}$ is placed into word No. 2 at time $t_2$.

The preceding action is iterated for 64 bit times during each of which the value $q=1$ is kept constant. The net result is that the contents of main register 35 contain the set of values $$c_1S_{1,1}, c_1S_{2,1}, \ldots, c_1S_{64,1}$$

where $$S_{k,1}=\sin[\pi(k\times 1)/W].$$

At time $t_{65}$, word counter 20 returns to its initial value of one and generates a Reset signal because this device is a counter modulo 2W, and W has been selected to have the value 32. The resetting of word counter 20 is detected from the Reset signal by adder-accumulator 22 and causes the accumulator to return to an initial value of zero. The Reset signal from word counter 20 is used to increment the count in harmonic counter 21 so that it now contains the value $q=2$. Harmonic counter 21 will retain the value of $q=2$ for 64 successive bit times. Therefore at time $t_{65}$, adder-accumulator 22 has the value $Nq=2$ and transmits this value to memory address decoder 27 which in turn causes the value $S_{1,2}=\sin[\pi(1\times 2)/W]$ to be read out of sine table 28. At time $t_{65}$, the harmonic coefficient $c_2$ is read from harmonic coefficient memory 30. The output signal from multiplier 32 is the value $c_2S_{1,2}$ which is added by means of adder 36 to the value $c_1S_{1,1}$ which at time $t_{65}$ resides in word No. 1 of main register 35. The sum $c_1S_{1,1}+c_2S_{1,2}$ is placed in storage in word No. 1 of main register 35 at time $t_{65}$. The preceding action starting at time $t_{65}$ is iterated for 64 successive bit times during which the value $q=2$ is maintained. The net result is that the contents of main register 35 contain the set of values $$c_1S_{1,1}+c_2S_{1,2}, c_1S_{2,1}+c_2S_{2,2}, \ldots, c_1S_{64,1}+c_2S_{64,2}.$$

At time $t_{129}$ word counter 20 returns to its initial value of one and again generates a Reset signal. The Reset signal causes adder-accumulator 22 to be initialized to a zero value and increments harmonic counter 21 so that it now contains the value $q=3$ which it retains for the next successive 64 bit times. At the end of this sequence of 64 bit times the contents of main register 35 are the set of values $$c_1S_{1,1}+c_2S_{1,2}+c_3S_{1,3}, \ldots, c_1S_{64,1}+c_2S_{64,2}+c_3S_{64,3}.$$

The preceding action is successively repeated for 32 sets of 64 bit times. At the end of $32\times 64=2048$ bit times the contents of the main register 35 are those indicated in Equation 1.

At time $t_{2049}$ the ring subcomputation cycle is initiated. During this subcomputation cycle, memory address decoder 29 causes harmonic coefficients $d_q$ to be read out of harmonic coefficient memory 31. The ring subcomputation cycle proceeds in a fashion analogous to the master subcomputation cycle with the accumulated sums from adder 36 now caused to be stored in ring register 56. At the end of U successive repetitions of sequence of 64 bit times, or a total of U × 64 bit times, ring register 56 contains the values indicated in Equation 2.

At the completion of both portions of the computation cycle consisting of the master subcomputation cycle and the ring computation cycle, executive control 16 initiates the start of the data transfer cycle. During the data transfer cycle, the contents of main register 35 are transferred in a controlled manner to note shift register 37 and the contents of ring register 56 are transferred to note shift register 38. While the description of the data transfer cycle is illustrated for two note shift registers, the extension to any multiplicity is apparent to those skilled in the art of logic design.

Each note shift register has its own separate bit position for a synchronizing bit. This bit position is always a "1" for a single word and is "0" for all other words. The synchronizing bit is used by various logic blocks to detect the initial phase state of the end-around shift registers as described below. More generally, the synchronizing data may consist of a synchronizing time data word.

When a first key has been actuated on the instrument keyboard switches 12, note clock 39 and note clock 40 are assigned by note detect and assignor 14. The note clocks 39 and 40 are not necessarily locked with the master clock and may run asynchronously. Note clock 39 is caused to run at a frequency corresponding to the key switch that has been actuated. Note clock 40 is generally caused to run at another preselected frequency which is not restricted to any musical frequency keyed on the instrument keyboard switches. Note detect and assignor 14 when it detects the closure of a keyboard switch causes a transfer of a control voltage, or detection signal, to each of the assigned note clocks which causes these clocks to operate at a rate of 64 times the fundamental frequencies assigned to the true musical note and the offset frequency of the ring generator.

A preferred implementation is to use a VCO (Voltage Controlled Oscillator) for note clocks 39 and 40. Means for advantageously implementing these VCO are described in copending U.S. Pat application No. 634,533 filed on Nov. 24, 1975 entitled FREQUENCY NUMBER CONTROLLED CLOCKS and now U.S. Pat. No. 4,067,254. VCO systems are well-known in the art and a wide selection from other systems can be used such as that described in U.S. Pat. No. 3,659,031 entitled Monophonic Electronic Musical Instrument With A Variable Frequency Oscillator Employing Positive Feedback.

Note clocks 39 and 40 cause their respective note shift registers 37 and 38 to transfer data end-around at their individual clock rates. When the word containing the synchronizing bit is read from one of the note shift registers, for example from note shift register 37, its presence is detected by synchronizing bit detector 41. When a synchronizing bit is detected, a phase time it initiated and a phase time signal is sent to note select 42 via line 43 which identifies the particular note shift register and serves to initiate the first subcycle of the data transfer cycle. Once the first subcycle has been initiated, it cannot be terminated by the detection of another synchronizing bit by synchronizing bit detector 41; for example one emanating from note shift register 38.

At the start of the first subcycle of the data transfer cycle, note select 42 uses the information received via line 43 to cause the output signal on line 44 from clock select 45 to change from master clock 17 to the clock rate generated by note clock 39. The word contents of main register 35 are then transferred sequentially to note select 42 via line 45. Note select 42 sends this data to load select 47. The load select logic blocks 46 and 47 either operate to load new data into their associated note shift registers or to permit these registers to operate in an end-around mode when the corresponding data transfer subcycle has been completed.

After note shift register 37 has been loaded with data transferred from the main register 35 at the clock rate determined by note clock 39, the first subcycle of the data transfer cycle is completed. The second subcycle is initiated by the next time that a synchronizing bit is detected by synchronizing bit detector 41 from the data being read from note shift register 38. The operation of the second subcycle is analogous to the first subcycle with note clock 40 now used for timing the transfer of data from ring register 56.

At the conclusion of the data transfer cycle, executive control 16 initiates a new computation cycle. While the next new computation cycle is underway, data is being read independently from both note shift registers 37 and 38 under control of their individual note clocks 39 and 40. By the described means, the master data set computed and temporarily stored in ring register 56 has been stretched to corresponding offset frequencies.

The output data from note shift register 38 is converted into a reference voltage by means of ring digital-to-analog converter 48. The output data from note shift register 37 is converted to an analog voltage by means of tone digital-to-analog convertor 50. The reference voltage generated by ring digital-to-analog convertor 48 is used as the voltage reference for tone digital-to-analog convertor 49. The net result is that the waveform sent to sound system 11 is the product of the waveforms generated by the two digital-to-analog convertors 48 and 50. Because the Digital-to-Analog Converter 50 uses the output of Ring Digital-to-Analog Convertor 48 as a reference voltage, there will be no output to the Sound System if either or both of the outputs is zero from the Note Shift Register 37. Thus, the action of the two digital-to-analog convertors constitutes a ring modulator, or a balanced modulator as described previously.

The use of one digital-to-analog convertor such as Ring Digital-to-Analog Convertor 48 to produce a reference voltage for a second digital-to-analog convertor (50) corresponding to an input signal comprises what can be called a signal interaction means. Signal modulators can be classified by the generic name of signal interaction means while the ring modulator, or balanced modulator, is a particular type of a signal interaction means.

The Sound System 11 can comprise any type of conventional sound utilization means including power amplifiers and speaker systems.

The REF voltage signal input to tone digital-to-analog convertor is added to the signal created by ring digital-to-analog converter 48. REF voltage signal is used when the ring modulator mode of system 10 is disabled and it is desired to generate musical tones without modulation by off-tune signals.

The sinusoid table 28 may comprise a read only memory storing values of $\sin(\pi\theta/W)$ for $0 \leqq \theta \leqq 2W$ at intervals of D, where D is called the resolution constant of the memory. D determines the minimum phase shift that can be given the sinusoid values in the table. The memory address decoder 27 accesses from the sinusoid table 28 the value $\sin(\pi Nq/W)$ corresponding to the number or argument Nq received from Adder-Accumulator 22. It may happen that a value of Nq present in Adder-Accumulator 22 does not correspond exactly to a stored sine value. In such situations, the memory address decoder 27 may round, or possibly truncate, the value of Nq so as to access the closest stored value from the sinusoid table 28. Alternatively, the memory address decoder 27 may access the next lower sine value address, or the next higher such value. The smaller the resolution constant, the greater will be the number of entries in the sinusoid table 28 and correspondingly there is a smaller round off error in evaluating terms $\sin(\pi Nq/W)$. For musical instrument tone systems, a sinusoid table having 256 entries is a satisfactory design and corresponds to a resolution constant $D=360/256=1.40625$ degrees.

Figure 2:
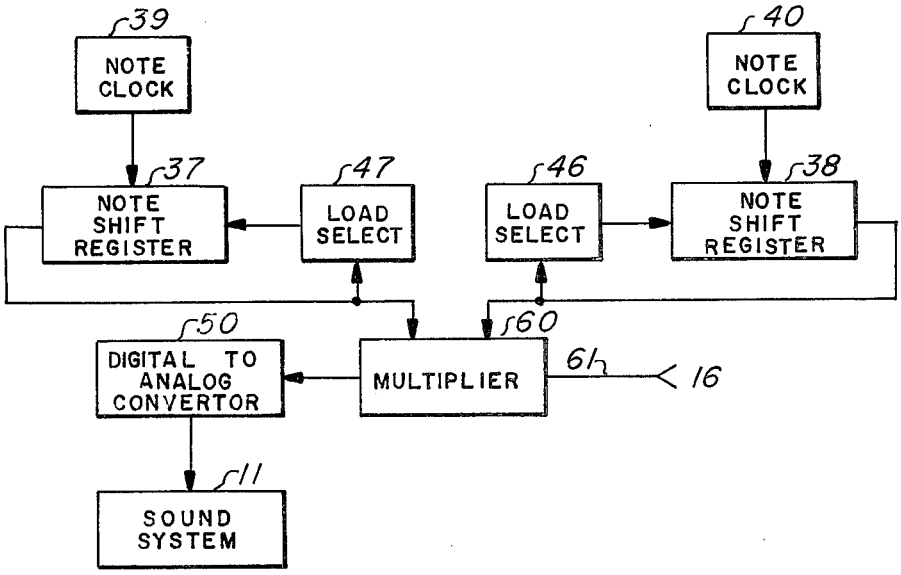
FIG. 2 is an electrical block diagram of an alternative means for implementing a ring modulator in a polyphonic tone synthesizer.

FIG. 2 shows an alternate output subsystem for effecting the multiplication of the waveshapes corresponding to the first and second master data sets. Here the output data out from note shift register 37 is multiplied by the output data read out from note shift register 38. The multiplication is performed by use of multiplier 60. Each input to multiplier 60 is held in temporary storage until a multiply signal on line 61 is received from executive control 16. When this multiply signal is received, multiplier 16 performs a multiplication of the data currently residing in its temporary storage and delivers the product data to digital-to-analog convertor 50. The analog signal created by digital-to-analog convertor 50 is sent to sound system 11.

Figure 3:
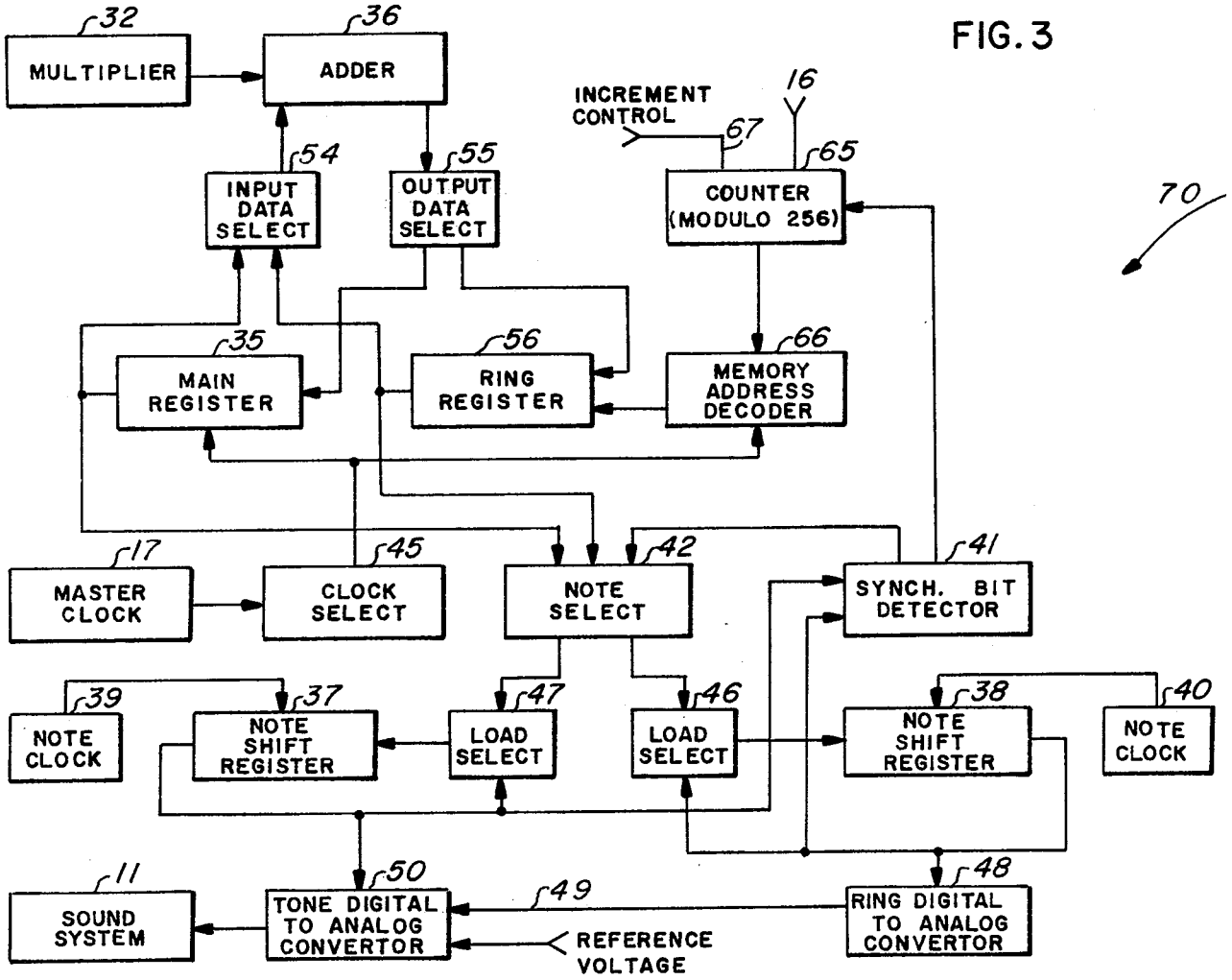
FIG. 3 is an electrical block diagram of a ring modulator in a polyphonic tone synthesizer in which the out-of-tune clock is created by linear phase shifted master data set.

FIG. 3 shows a modification to system 10 of FIG. 1. System 70 of FIG. 3 illustrates a Ring Modulator system in which the frequency offset frequency can be selected by a combination of assigning a frequency to note clock 40 and a phase shift subsystem which produces offset frequencies.

The first subcycle of the computation cycle for system 70 of FIG. 3 is the same as that previously described for system 10 of FIG. 1. At the end of the computation cycle the contents of main register 35 are those indicated in Equation 1.

During the second subcycle of the computation cycle for system 70 the data residing in ring register 56 is computed according to the relation $$V_M = \sum_{q=1}^{U} d_q \sin(\pi Mq/W) \qquad \text{(Equation 4)}$$

for values of $M=1,2,3,\ldots,Q\times 2W$. Advantageously, $Q=4$ so that ring register 56 contains 256 data words. The computation of Equation 4 is accomplished by causing word counter 20 of FIG. 1 to have a count modulo 256 for the second subcycle of the computation cycle.

At the start of each computation cycle, counter 65 is caused to increment. Counter 65 is advantageously selected as a counter modulo 256.

During a data transfer cycle, the data stored in main register 35 is transferred to note shift register 37 in the manner previously described for system 10 of FIG. 1.

During the portion of the data transfer cycle in which data is read out of ring register 56, memory address decoder 66 causes data to be read at every H'th data point. Advantageously H is selected as $H=4$. However, the initial address of ring register 56 is selected by memory address decoder 66 in response to the contents of counter 65. Because the initial address is changed for each read out, a time increasing phase shift is created in the data read out from ring register 56. This time increasing phase shift manifests itself as an increase in the frequency of the waveform created by reading data out of the corresponding note shift register 38. The phase increment is controlled by signals introduced into counter 65 by the increment control signal on line 67. These signals cause the counter 65 to increment by one unit, two units, four units, etc. in response to the increment signal received from executive logic 16 at the start of a computation cycle. The initial address generated by memory address decoder 66 is called the phase start number h.

The data read out from note shift register 38 is converted into an analog voltage by means of ring digital-to-analog converter 48. The resulting analog voltage is sent via line 49 to digital-to-analog convertor 50 which converts the data read out from note shift register 37. The signal on line 49 acts as the conversion reference voltage for digital-to-analog convertor 50 so that the net result is that the signal sent to sound system 11 represents the product of the on-tune waveshape and the offset frequency waveshape.

Figure 4:
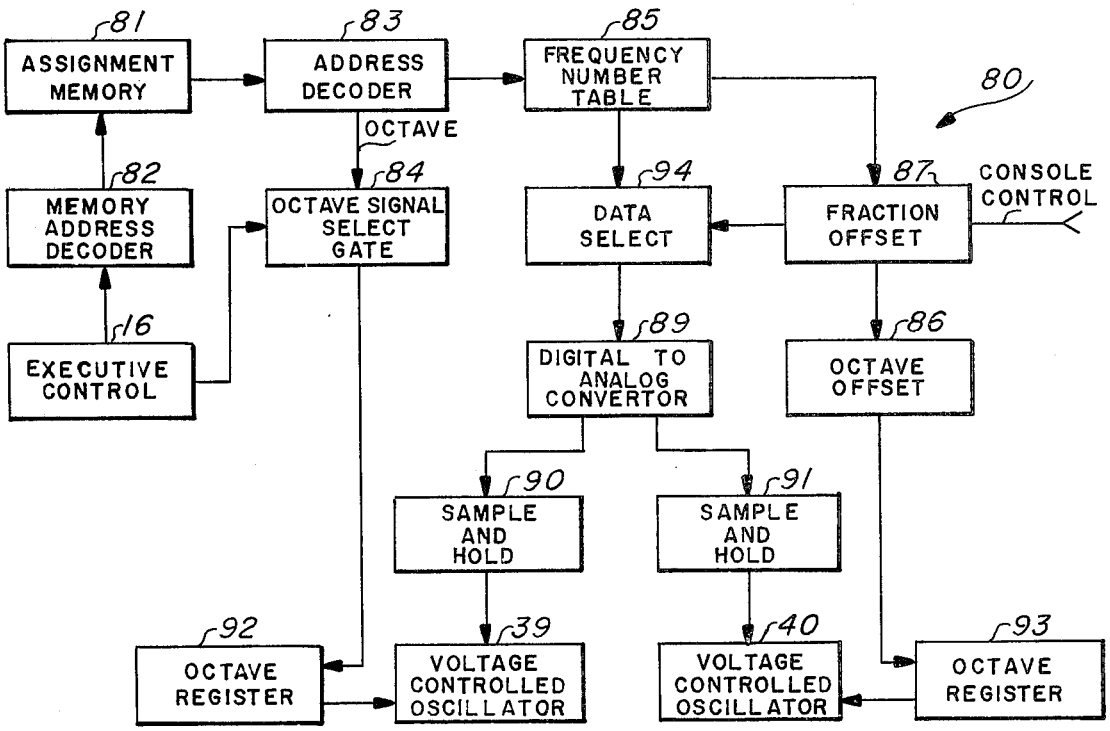
FIG. 4 is a block diagram of a system to produce in-tune and out-of-tune frequency clocks.

System 80 of FIG. 4 shows a subsystem for inplementing note clocks 39 and 40 of FIG. 1. System 80 is analogous to that described in the copending U.S. Patent application No. 634,533 filed on Nov. 24, 1975 entitled FREQUENCY NUMBER CONTROLLED CLOCKS and now U.S Pat. No. 4,067,254.

Executive control 16 cyclically and repetitively generates control signals which are furnished to memory address decoder 82. Memory address decoder 82 transforms the signals received from executive control 16 into a form which causes corresponding data words to be read from assignment memory 81.

Assignment memory 81 is a read/write memory which may be a RAM (Random Access Memory) or may advantageously be a shift register operating in an "end-around" read out mode. For a key detect and assign system such as disclosed in the previously referenced U.S. Pat. No. 4,022,098 herein used for illustration purposes, the data words contained in assignment memory 81 consist of 1 bit (LSB) to indicate assigned or unassigned status of a corresponding voltage controlled oscillator used as a note clock; 2 bits denote the musical instrument division and can be used to select a particular data set to be written into note shift registers 37 and 38; 3 bits denote the octave on the musical instrument's keyboard; 4 bits denote the musical note within an octave.

Address decoder 83 decodes the bits denoting an assigned note in a form suitable for addressing data stored in frequency number table 85.

Frequency number table 85 is a ROM (Read Only Memory) containing frequency data words in binary form. These data words are the values of $2^{-(n/12)}$; $n=1,2,\ldots,12$ and as such represent the ratios of frequencies in an equaltempered musical scale. While frequency number table 85 is advantageously a ROM, it is an obvious extension to use a RAM so that new frequency data words can readily be introduced when it is desired to generate clock frequencies which do not correspond to the equal-tempered musical scale but which may correspond to any desired set of frequencies.

The frequency data words read from frequency number table 85 are directed by means of data select 94 to digital-to-analog convertor 89 when the data is used to create a note clock at the frequency corresponding to the switch actuated on the instrument's keyboard. When the data is used to create the companion offset frequency, the data read out from frequency number table 85 is sent to fraction offset 87. Fraction offset 87 adds (or subtracts) a predetermined numerical value from the data read out from frequency number table 85. The predetermined value for the offset frequency is placed into fraction offset 87 from a console control. At the same time, an octave offset signal is sent to octave offset 86 which places the corresponding note clock in an octave which may differ from the true octave being keyed on the instrument. Digital-to-analog convertor 89 is time shared between the two input data streams and converts the input binary data to analog voltages. Sample and hold 90 retains the converted analog voltage for the intune note clock between conversion times while sample and hold 91 retains the converted analog voltage for the offset note clock between conversion times.

Voltage controlled oscillators 39 and 40, which are the note clocks shown in FIG. 1, each contain sets of frequency determining elements corresponding to each octave of the musical instrument's keyboard. The octave data detected by octave signal select gate 84 is sent to octave register 92 which has a temporary storage for retaining the current assigned octave data. Octave register 92 contains circuitry for selecting frequency determining elements associated with each octave and contained within voltage controlled oscillator 39. Similarly octave register 93 has a temporary storage for retaining the current octave data inserted into the system by means of the console control.

It is well-known in mathematical art that for a period of a waveshape, such as that used in musical sounds, that generalized harmonic series can be used to represent the waveshape. Such generalized harmonic series include but are not limited to the Fourier series of the types shown in Equation 1 through Equation 4. The generalized harmonic series is written in the worm $$Z_n = \sum_q a_q \phi_q(n) \qquad \text{(Equation 5)}$$

where $\phi_q(n)$ denotes any member of the family or orthogonal functions or orthogonal polynomials. By analogy with conventional Fourier series, the coefficients $a_q$ are called generalized Fourier harmonic coefficients. Frequently Equation 5 is called a discrete generalized Fourier transform. The The orthogonal polynominals include Legendre, Gengenbauer, Jacobi, and Hermite polynominals. The orthogonal functions include Walsh, Bessel, and trigonometric. For purposes of language used in claims, the term orthogonal function is used generically to include both orthogonal functions and orthogonal polynomials. Although the various features of the subject invention are illustrated for a single in tune and a single offset waveshape generator, this is not an inherent limitation and the extension to any number of such waveshape generators is an obvious modification. These wave shape generators can be either digital or analog.

While the subject invention is illustrated in conjunction with the Polyphonic Tone Synthesizer in the above-mentioned U.S. Pat. No. 4,085,644, it is not thereby limited to such a tone generator. Intending to claim all novel, useful and unobvious features shown or described, the applicant makes the following

I claim:

1. A musical instrument exhibiting a ring modulator effect whereby multiple signals are combined to produce a combination signal containing spectral components corresponding to multiples of the sum and difference frequencies of said multiple signals, said musical instrument comprising;

a computation cycle comprising a first portion wherein numbers Z(N) are computed and a second portion wherein numbers R(N) are computed, a first memory means for writing a first master data set to be thereafter read out, wherein contents are set to zero values at start of said first portion of said computation cycle and wherein number N designates the address of words in said first memory means, a second memory means for writing a second master data set to be thereafter read out, wherein contents are set to zero values at start of said second portion of said computation cycle and wherein number H designates the address of words in said second memory means, first means for computing numbers Z(N) in said first master data set in accordance with the relation $$Z(N) = \sum_{q=1}^{W} c_q \sin(\pi Nq/W)$$

where q = 1,2, . . . ,W; N = 1,2, . . . ,2W; W is the number of harmonic components defining said number Z(N) in first master data set and $c_q$ is the harmonic coefficient of the corresponding $q^{th}$ component; and for computing numbers R(H) in said second master data set in accordance with the relation $$R(H) = \sum_{q=1}^{U} d_q \sin(\pi Hq/QW)$$

where H= 1,2, . . . ,QN is an index designating the component numbers in the second master data set, U is a number not greater than said number W and is the number of harmonic components defining R(H); $d_q$ is the harmonic coefficient of the corresponding $q^{th}$ component; and Q is a phase resolution constant; said first means comprising:

a memory storing said harmonic coefficients sets $c_q$ and $d_q$, a sinusoid table comprising a memory storing values of sin $(\pi\phi/W)$ for $0 \leqq \phi \leqq 2W$ at intervals of D where D is a resolution constant, and harmonic component evaluation circuitry utilizing said memory for storing said harmonic coefficients and said sinusoid table to calculate $c_q \sin(\pi Nq/W)$ for each of the W harmonic components of said numbers Z(N) in accordance with a selected value of N and to calculate $d_q \sin(\pi Hq/WQ)$ for each of the U harmonic components of said numbers R(H) in accordance with selected values of H and said resolution constant Q;

a means for successively algebraically summing output of said harmonic component evaluation circuitry with contents of word N in said first memory means during said first portion of said computation cycle and for successively algebraically summing output of harmonic component evaluation circuitry with contents of word H in said second memory means during said second portion of computation cycle, a third memory means for writing data to be thereafter read out, a fourth memory means for writing data to be thereafter read out, a second means responsive to said first means for transferring said first master data set from said first memory means to said third memory means and for transferring phase shifted data from said second memory means to said fourth memory means, and a third means responsive to said second means for providing musical tones in accordance with the product of waveshapes corresponding to said first and second master data sets whereby said musical tones exhibiting said ring modulator effect.

2. A musical instrument according to claim 1 wherein said harmonic component evaluation circuitry comprises;

a word counter incremented at each computation time in said first portion of said computation cycle wherein said word counter counts modulo 2W, the contents of said word counter thereby represents said number N, and said word counter is incremented at each computation time in said second portion of said computation cycle and wherein said word counter counts modulo 2QW, the contents of said word counter thereby represents said number H, modulo reset circuitry whereby a reset signal is created when said word counter is reset at its maximum count, a harmonic counter incremented by said reset signal wherein said harmonic counter counts modulo said number W during said first portion of said computation cycle and counts modulo said number U during said second portion of said computation cycle, and thereby the contents of said harmonic counter is said harmonic number q, an adder-accumulator for adding successive values of said harmonic number q contained in said harmonic counter wherein said adder-accumulator is initialized to zero value by said reset signal, thereby the content of said adder-accumulator is number Nq during said first portion of computation cycle and thereby the content of said adder-accumulator is number Hq during said second portion of computation cycle, a first memory address decoder for addressing said sinusoid table in response to said contents in said adder-accumulator whereby during said first portion of computation cycle the value $\sin(\pi\ Nq/W)$ corresponding to said number Nq is accessed from said sinusoid table and whereby during said second portion of computation cycle the value $\sin(\pi\ Hq/WQ)$ corresponding to said number Hq is accessed from said sinusoid table, and a multiplier means for multiplying each said accessed value from said sinusoid table by said harmonic coefficient $c_q$ for the corresponding $q^{th}$ harmonic component during said first portion of said computation cycle and for multiplying each said accessed value from said sinusoid table by said harmonic coefficient $d_q$ during said second portion of computation cycle, the product of such multiplication being supplied to said means for successively algebraically summing.

3. A musical instrument according to claim 2 wherein said second means comprises:

a cycle counter which is incremented repetitively where cycle counter is modulo said number 2WQ, the contents of cycle counter being a phase start number h, and second memory addressing means comprising circuitry whereby during said data transfer, data is caused to be addressed from said second memory means for the sequence of N word addresses, h, h+Q, h+2Q, h+3Q,. . ., h+(N-1)Q; the elements of said sequence being numbers modulo QN, thereby producing phase shifted data points.

4. A keyboard musical instrument incorporating a keyboard switch system, said musical instrument having keyboard actuated note selection switches and other switches controlling the characteristics of musical sounds generated by said musical instrument, said musical instrument exhibiting a ring modulator effect, whereby multiple signals at different frequencies are combined to produce a combination of signals containing spectral components corresponding to multiples of the sum and difference frequencies of said multiple signals, said musical instrument comprising:

a first memory means for writing a first master data set to be thereafter read out, wherein number N designates address of words in said first memory means, a second memory means for writing a second master data set to be thereafter read out, wherein said number N designates the address of words in said second memory means, means to set contents of said first memory means and said second memory means to zero values at start of computation cycle, first means for computing numbers Z(N) in said master data set and for computing numbers R(N) in said master data set during said computation cycle in accordance with the relations $$Z(N) = \sum_{q=1}^{W} c_q \sin(\pi Nq/W)$$

$$R(N) = \sum_{q=1}^{W} d_q \sin(\pi Nq/W)$$

where N = 1,2, . . . ,2W; W is the number of the harmonic components defining said number Z(N) and $c_q$ is the harmonic coefficient of the corresponding $q^{th}$ component; U, not greater than W, is the number of harmonic components defining said number R(N) and $d_q$ is the harmonic coefficient of the corresponding $q^{th}$ component; said first means comprising;

a memory storing said harmonic coefficient sets $c_q$ and $d_q$, a sinusoid table comprising a memory storing values of $\sin(\pi\phi/W)$ for $0 \leqq \phi \leqq 2W$ at intervals of D where D is a resolution constant, and harmonic component evaluation circuitry utilizing said memory for storing said harmonic coefficients and said sinusoid table to calculate $c_q \sin(\pi\ Nq/W)$ for each of the W harmonic components of said numbers Z(N) in accordance with a selected value of N and to calculate $d_q \sin(\pi$ Nq/W) for each of the U harmonic components of said numbers R(N) in accordance with a selected value of N;

a means for successively algebraically summing output of said harmonic component evaluation circuitry selectively with contents of word N in said first memory means and with contents of word N in said second memory means, a third memory means for writing data to be thereafter read out, a fourth memory means for writing data to be thereafter read out, a second means responsive to said first means for transferring said first master data set from said first memory means to said third memory means and for transferring said second master data set from said second memory means to said fourth memory means, and a third means responsive to said second means for providing musical tones corresponding to said ring modulator effect produced by the product of waveshapes corresponding to said first and second master data sets.

5. In a musical instrument according to claim 4 where said third means comprises;

a first and second note clocks having adjustable rates, assignor means comprising circuitry for adjusting rates of said first and second note clocks responsive to closure of said musical instrument's keyboard actuated note selection switches, means for causing said first note clock to read out contents of said third memory means and for causing said second note clock to read out contents of said fourth memory means, a first and second convertor respectively receiving contents read out from said third and fourth memory means wherein analog signals are provided corresponding to said received contents, and signal interaction means wherein said analog signal provided by said second converter is caused to modulate said analog signal provided by said first convertor thereby producing said ring modulator effect.

6. A musical instrument according to claim 5 wherein said first memory means, said second memory means, said memory, said third memory means, said fourth memory means, and said sinusoid table are digital devices in which said coefficients and values are stored in digital form, wherein said first means for computing is digital, and wherein said first and second convertors comprise digital-to-analog convertors.

7. A musical instrument according to claim 5 wherein note selection is accomplished by assignor means comprising;

means for detecting closure of said keyboard actuated note selection switches and generating corresponding detection signals, means for associating said detection signals with musical notes, and further comprising circuitry for assigning said first and second note clocks to said closed keyboard actuated note selection switches and for adjusting rate of said first note clock to a frequency 2W times that of said musical notes and for adjusting rate of said second note clock to a predetermined frequency differing from that of said first note clock, and means for detecting opening of said keyboard actuated note selection switches and thereupon generating a release signal, and circuitry responsive to said release signal to cause corresponding said first and second note clocks to be inhibited thereby terminating read out of contents of corresponding said third and fourth memory means.

8. A musical instrument according to claim 4 wherein said third means comprises;

first and second note clocks having adjustable rates, assignor means comprising circuitry for adjusting rates of said first and second note clocks responsive to closure of said musical instrument's keyboard actuated note selection switches, means for causing said first note clock to read out contents of said third memory means and for causing said second note clock to read out contents of said fourth memory means, multiplication means wherein product data is generated by multiplying data read out from said third memory means with data read out from said fourth memory means, and conversion means wherein analog signals exhibiting said ring modulator effect are created from said product data.

9. A musical instrument according to claim 4 wherein said harmonic component evaluation circuitry comprises;

a word counter incremented at each computation time in said computation cycle wherein said word counter counts modulo 2W, the contents of said word counter thereby represents said number N, modulo 2W reset circuitry whereby a reset signal is created when said word counter is reset when content N is equal to 2W, a harmonic counter incremented by said reset signal wherein said harmonic counter counts modulo said number W during the subcomputation cycle wherein said number Z(N) are evaluated and counts modulo said number U during the subcomputation cycle wherein said numbers R(N) are evaluated; thereby the contents of said harmonic counter is said harmonic number q, and an adder-accumulator for adding successive values of said harmonic number q contained in said harmonic counter wherein said adder-accumulator is initialized to zero value by said reset signal, thereby the content of said adder-accumulator is number Nq.

10. A musical instrument according to claim 9 wherein said subcomputation cycle comprises a first portion during which said numbers Z(N) are evaluated and a second portion during which said numbers R(N) are evaluated and wherein said means for successively algebraically summing comprises;

a first and second memory addressing means responsive to said number N in said word counter whereby during said computation cycle contents addressed in said first and second memory means are read out, an output data gate whereby during said first portion of said computation cycle causes output data to be written in said first memory means and whereby during said second portion of computation cycle causes output data to be written in said second memory means, an input data gate whereby during said first portion of said computation cycle causes input data to be read out of said first memory means and whereby during said second portion of computation cycle causes input data to be read out of said second memory means, and an adder for algebraically summing said numbers $c_q \sin(\pi Nq/W)$ from said harmonic component evaluation circuitry with said input data from said input data gate during said first portion of said computation cycle, the summed values provided as said output data to said output data gate thereby causing summed values to be written in said first memory means, and wherein said numbers $d_q \sin(\pi Nq/W)$ from harmonic component evaluation circuitry during said second portion of computation cycle are algebraically summed with said input data from said input data gate, the summed values provided as said output data to output data gate thereby causing summed values to be written in said second memory means.

* * * * *